US007351047B2

(12) United States Patent
Kawakami et al.

(10) Patent No.: US 7,351,047 B2
(45) Date of Patent: Apr. 1, 2008

(54) SWASH-PLATE VARIABLE VOLUME CHAMBER-TYPE FLUID MACHINE

(75) Inventors: Tohru Kawakami, Tokyo (JP); Makoto Kawakami, Tokyo (JP)

(73) Assignee: Anelva Technix Corporation, Tokyo (JP)

( * ) Notice: Subject to any disclaimer, the term of this patent is extended or adjusted under 35 U.S.C. 154(b) by 465 days.

(21) Appl. No.: 10/521,770

(22) PCT Filed: Sep. 24, 2003

(86) PCT No.: PCT/JP03/12148

§ 371 (c)(1),
(2), (4) Date: Jan. 19, 2005

(87) PCT Pub. No.: WO2004/051088

PCT Pub. Date: Jun. 17, 2004

(65) Prior Publication Data

US 2005/0271523 A1 Dec. 8, 2005

(30) Foreign Application Priority Data

Sep. 24, 2002 (JP) ..... 2002-278060

(51) Int. Cl.
*F03C 4/00* (2006.01)
*F04C 15/00* (2006.01)

(52) U.S. Cl. ..... 418/195; 418/192; 418/229

(58) Field of Classification Search ..... 418/192, 418/195, 229
See application file for complete search history.

(56) References Cited

U.S. PATENT DOCUMENTS 806,297 A * 12/1905 Sheahan ..... 418/229
2,101,428 A * 12/1937 Cuny ..... 418/195
3,040,664 A * 6/1962 Hartley ..... 418/195
4,648,813 A * 3/1987 Mikulan ..... 418/193

FOREIGN PATENT DOCUMENTS

| | | |
|---|---|---|
| JP | 55-4956 | 2/1980 |
| JP | 2000-87885 | 3/2000 |
| JP | 2001-3876 | 1/2001 |
| JP | 2002-364572 | 12/2002 |

OTHER PUBLICATIONS

English Language Abstract of JP 2001-3876.
English Language Abstract of JP 2000-87885.
English Language Abstract of JP 2002-364572.

* cited by examiner

*Primary Examiner*—Theresa Trieu
(74) *Attorney, Agent, or Firm*—Greenblum & Bernstein, P.L.C.

(57) ABSTRACT

The present invention provides an improved swash plate type variable capacity fluid machine which is fluid-tight, simple in structure, quiet in operation, and highly durable, yet without increasing its size, weight, and the amount of power loss. The swash plate type variable capacity fluid machine includes: a cone; a disk; an enclosure wall whose inner shpherical surface surrounds the outer circumference of the disk; and a partition plate movably fitted in a groove of the cone. The cone and the disk are arranged to confront each other on an abutment line, thereby defining a plurality of variable capacity compartments. Supplying/discharging holes are provided to communicate with the variable capacity compartments, supplying and discharging a fluid there from. A synchronous mechanism causes the cone and the disk to rotate about their center axis in synchronization.

4 Claims, 11 Drawing Sheets

SWASH-PLATE VARIABLE VOLUME CHAMBER-TYPE FLUID MACHINE

TECHNICAL FIELD

The present invention relates to a swash plate type variable capacity fluid machine, which is comprised of a conical body, a disk body, a partition plate, an enclosure wall, and other parts together defining separate variable capacity compartments to supply and discharge applied fluid alternately.

BACKGROUND ART

Patent Document 1 (Japan Patent Application, Publication No. S55-4956) shows a swash plate pump. The pump housing has a cone formed in its spherical space, and an oblique disk is fitted in the spherical space with its center on the top of the cone. The oblique disk can rotate about the center axis of the cone while being kept both in contact with the conical surface and the inner spherical surface of the housing. The cone has one radius groove made on its conical surface, and a partition plate is movably fitted in the groove so that it may swing while constantly abutting on and following the oblique disk, thereby defining variable capacity compartments between the cone and the oblique disk. The cone has supplying and discharging through holes made right next to the partition plate. This type of pump is simple in structure and is relatively small in size. It works quietly, discharging fluid almost continuously. Also, reversal operations are permitted to drive fluid in the opposite directions.

It is, however, necessary that such swash plate pump be equipped with check valves for pressure feeding, and accordingly the pump size is increased. Also disadvantageously, an operation of the valves causes noise and significant quantities of power loss. Furthermore, the inner spherical surface of the enclosure wall is rubbed all the time by the oblique disk to be worn, causing leaks in the pump to lower its durability.

With a view to reducing such defects, inventors of the present invention have proposed an improved swash plate pump described in Patent Document 2 (Japan Patent Application, Laid-Open No. 2001-3876). It comprises: a cone rotatable about its center axis, a disk confronting the cone with their center axes crossing, a spherical enclosure wall integrated with the cone, and a partition plate movably fitted in one diametrical groove made in the cone. The partition plate moves in the groove while constantly abutting on and following the disk, thereby dividing a cone-and-disk confronting space into separate variable capacity compartments. In operation, the cone and the disk are rotated in synchronization about their center axes.

With this arrangement, a stationary abutment line is defined at the radius of the disk at which the disk is kept contact with a conical surface while rotating. Different from the case with the conventional swash plate pump, the speed of the disk relative to the surrounding spherical wall is reduced, thereby improving the durability of the pump and also expanding applicable types of fluid to dry kind, which does not cause any lubrication at rubbing surface. Supplying and discharging through holes are made in the disk that rotates, and these through holes can be timely opened and closed to form a gating structure, thereby getting rid of check valves. The so improved swash plate pump can supply and discharge fluid quietly at an increased efficiency. Disadvantageously, the swash plate pump of Patent Document 2 allows a discharging pressure in the selected variable compartments to be applied to the rotary members along their axes, thereby separating the disk from the cone to allow fluid to leak across the abutment line. This inhibits an increase of the discharging pressure beyond a certain limit. Also disadvantageously, application of the discharging pressure to the disk at even low level makes it rub the spherical wall with an increased force, causing lowering of the durability of the pump due to thermal expansion and significant wear.

In the hope of solving these problems, bearings are designed to provide controlled counter pressure or spring means are used to cause the same effect, but these will induce significant power loss. The axial rigidity of the rotary members and the housing supporting them cannot be enforced without increasing the weight and size of the pump. In order to increase the flow rate and the discharging pressure, and to widen applicable type of fluid to include vacuum pumping, it is necessary that: no leak be caused at the rubbing areas; gas be compressed under the lubrication-free rubbing condition; and a correct timing be assured in supplying and discharging operations in response to the fluid-pressure.

Fluid-pressure exploiting machines of similar structure which are responsive to application of pressurized fluid for rotation such as in a hydraulic motor have these problems in common. As a matter of course, the problems other than leakage across the abutment line need to be solved in all the swash plate type variable capacity fluid machines, including swash-plate vane type fluid machines having variable capacity compartments formed by a plurality of vanes.

SUMMARY OF THE INVENTION

One object of the present invention is to provide a swash plate type variable capacity fluid machine which is guaranteed to be free of leaks at boundaries of variable capacity compartments and parts-rubbing areas without causing the increase in its size, weight, and power loss during operation, but still assuring quietness and durability of the machine by a simple structure.

The present invention defines a swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; partitioning means for dividing the space between the conical body and the disk body into a plurality of variable capacity compartments in respect of radius lines on the disk surface; and supplying/discharging through holes communicating with the variable capacity compartments; characterized in that: the partitioning means comprises a partition plate movably fitted in a diameter groove of the conical body and an abutment line formed between the conical body and the disk body on their confronting surface; the enclosure wall is integrally connected to the disk body; and the conical body and the disk body are provided with a synchronous mechanism thereby synchronizing their rotation about their center axes.

Furthermore, the present invention defines the swash plate type variable capacity fluid machine, wherein the conical body has a rear axle integrally extending along its center axis on the rear side, the rear axle having an end surface onto which an increased pressure is delivered from the variable capacity compartments via pressure channels, the end surface thus applying a counter force in the direction of the variable capacity compartments.

Furthermore, the present invention defines the swash plate type variable capacity fluid machine, wherein the rear axle has a cylindrical axle integrally constructed to support the rear axle, the cylindrical axle having a plurality of through holes made on its entire circumference at regular intervals, thereby permitting applied fluid to pass through the through holes.

Furthermore, the present invention defines the swash plate type variable capacity fluid machine, wherein the disk body has supplying/discharging through holes communicating with the variable capacity compartments on one end and with a gate member on the other end, the gate member gating supplying/discharging channels in response to its predetermined angular positions, thereby supplying and discharging applied fluid.

DETAILED DESCRIPTION OF THE PREFERRED EMBODIMENT

Figure 1:
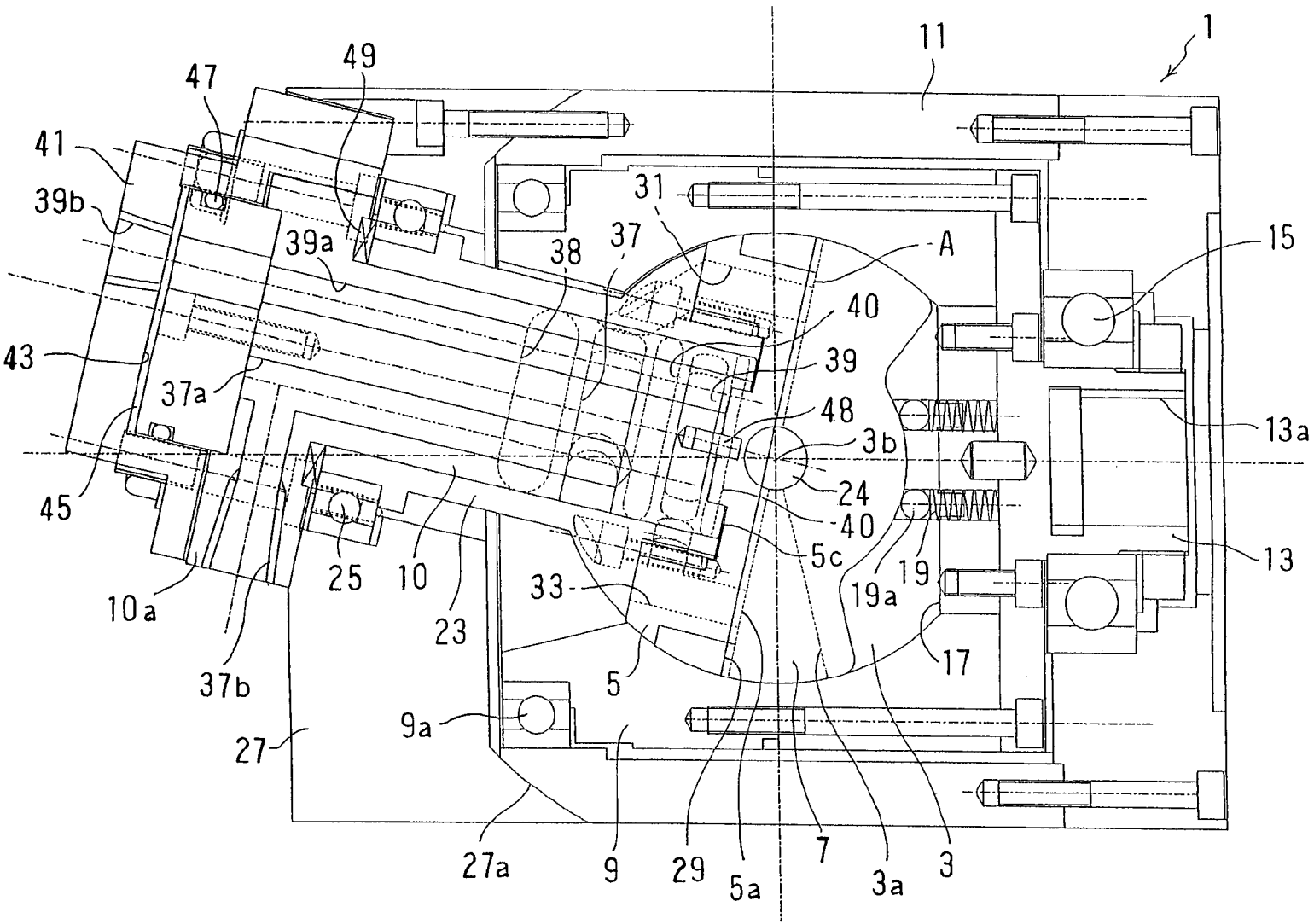
FIG. 1 is a longitudinal section of a swash plate type variable capacity fluid machine according to one embodiment of the present invention.

Some preferred embodiments of the present invention will be described below by referring to the drawings.

Figure 2:
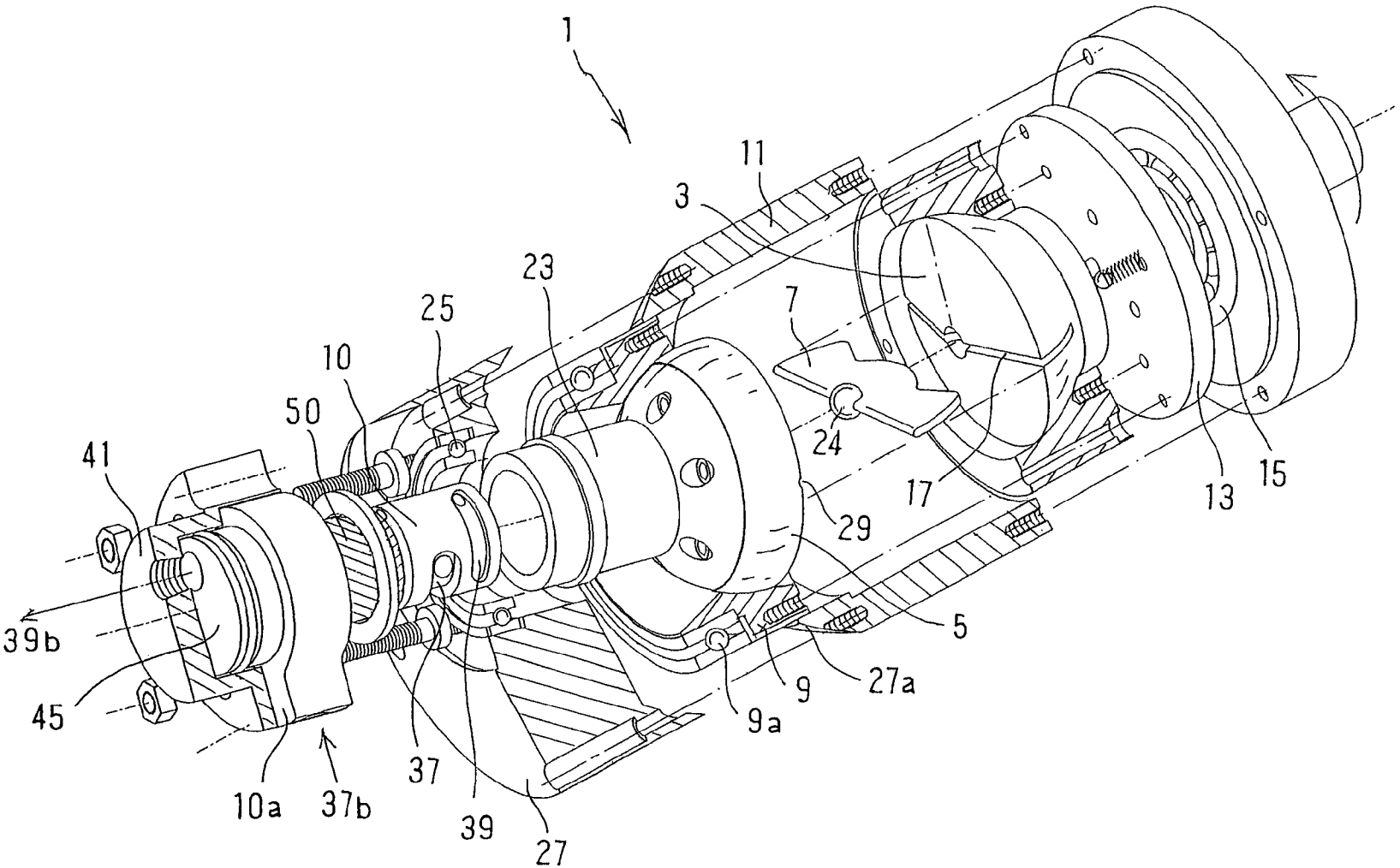
FIG. 2 is an exploded view of the fluid machine of FIG. 1.

FIG. 1 is a longitudinal section of a swash plate type variable capacity pump according to the first embodiment of the present invention, and FIG. 2 is an exploded view of said swash plate pump. As shown in these drawings, the swash plate type variable capacity pump 1 mainly comprises a cone 3, a disk 5, a partition plate (vane) 7, and an enclosure wall 9, all of which are rotatably incorporated in a housing 11 so as to define variable capacity compartments, and is further provided with a gate member 10, thereby being constructed as a rotary type pump.

Specifically, the cone 3 that has a predetermined vertex angle confronts the disk 5, abutting on a conical surface 3*a*, and is integrally and coaxially connected to a cone (or rear) axle 13 placed on its rear side. The cone axle 13 is rotatably supported to the housing 11 by an associated bearing 15. The cone 3 has a groove 17 made on a diameter line across the conical surface 3*a*, and the partition plate 7 is movably fitted in the groove 17. A pair of small balls 19*a* and springs 19 are put in two holes, which are made in the cone 3 in an equidistant positions from the center axis of the cone 3, to support a base edge of the partition plate 7. The partition plate 7 receives pushing force from the springs 19 via the small balls 19*a*, thereby enabling the partition plate 7 to follow the disk 5 all the time.

The enclosure wall 9 forms a concave spherical wall that surrounds outer circumference of the cone 3 with a cone tip 3*b* as a spherical center, and is integrally connected to the cone axle 13. The enclosure wall 9 is supported at its edges by bearings 9*a*, thereby surrounding the partition plate 7 and the disk 5 on their outer circumstances, where the plate 7 and the disk 5 slide on the spherical wall of the enclosure wall 9. With this arrangement, three separate variable capacity compartments are defined by the partition plate 7 and a stationary abutment line A appearing between the cone 3 and the disk 5. The cone axle 13 has a rear joint 13*a* formed at its end, so that a drive power may be applied via the rear joint 13*a*.

The cone 3 and the disk 5 are arranged in confronting relation on a circular disk surface 5*a*, and a cylindrical disk (rear) axle 23 integrally and coaxially constructed on the rear side of the disk 5 is rotatably supported to a crossing axle support 27 by an associated bearing 25. The cone 3 and the disk 5 are so arranged that the disk surface 5*a* radially abuts the conical surface 3*a* with their center axes crossing at the cone tip 3*b*. The crossing axle support 27 is mounted to the housing 11 on a mounting surface 27*a*, which is spherically formed with its center coincident with the cone tip 3*b* for the purpose of arranging an angle of the center axis of the disk 5. The disk 5 has an engagement groove 29 made on a selected diameter on the disk surface 5*a*. The engagement groove 29 is semicircular in cross section with its radius half-sized of thickness of the partition plate 7 so as to allow a rounded edge of the partition plate 7 be snugly fitted in the groove 29, thereby providing a synchronous mechanism that allows the cone 3 and the disk 5 to rotate in synchronization when supplied with rotation power transmitted via the partition plate 7.

The disk 5 has a core ball 24 concentrically placed in a center recess on the circular disk surface 5*a*, so that the disk 5, the cone 3, and the partition plate 7 are all together put in compartmentalizing relationship under fluid-tight condition. The disk 5 has a supplying through hole (supplying/discharging through hole) 31 and a discharging through hole (supplying/discharging through hole) 33, opening at predetermined positions in the disk surface 5*a*, and leading to a hollow space of the cylindrical disk axle 23. The supplying/discharging holes 31 and 33 work as fluid paths to supply and discharge fluid in and from the variable capacity compartments, and are respectively arranged next to the partition plate 7 in each of two semicircular sections divided by the partition plate 7.

The gate member 10, which controls opening-and-closing of the supplying/discharging holes 31 and 33, is telescoped in the hollow space of the cylindrical disk axle 23. The gate member 10 is provided with an arc-slotted supplying gate 37 (supplying/discharging gate) and an arc-slotted discharging gate 39 (supplying/discharging gate), which communicate with the supplying/discharging through holes 31 and 33 respectively in response to a rotation angle of the disk 5. Also, the gate member 10 is provided with a supplying channel 37*a* (supplying/discharging channel) and a discharging channel 39*a* (supplying/discharging channel), which communicate with the supplying gate 37 and the discharging gate 39 respectively. The gate member 10 further comprises two shallow slots, namely counter windows 38 and 40 opposing to the supplying/discharging gates 37 and 39 respectively to receive a fluid pressure from each corresponding gate. A magnetic fluid seal (not shown) is formed on either side of the supplying gate 37 to provide a supplying block including the counter window 38, thereby blocking the fluid pressure from the discharging side, and thus maintaining a relatively wide annular gap. The supplying gate 37 and the discharging gate 39 along with the counter windows 38 and 40 are described later in detail.

The supplying channel 37*a* communicates with a supplying port 37*b*, which is made in an anti-rotation stud 10*a* of the gate member 10. The discharging channel 39*a* passes through an end room 43, which is made in a cover plate 41 closing the end of the gate member 10, and the discharging port 39*b* is made in the cover plate 41. An end surface 45 of the gate member 10, which faces the end room 43, is so sized that the discharging pressure from the selected variable capacity compartments may be lowered, or conversely pushed back if occasion demands.

O-rings 47 are provided between the cover plate 41 and the gate member 10 so as to seal the end room 43 to be fluid-tight, and a thrust bearing 49 is provided between the cylindrical disk axle 23 and the gate member 10 to seal the cylindrical disk axle 23 to be fluid-tight at its end. When occasions demand, a fluid dynamic pressure bearing 50 having symmetric herringbone grooves as shown in FIG. 2 made on its circumference may be used to support the gate member 10 radially in non-contact fashion. The inner side of the gate member 10 is pivoted at its center by a center pivot pin 48 provided on a rear surface 5*c* of the disk 5. The rear surface 5*c* of the disk 5 forms a pressure exposed area which is exposed to the discharging pressure from the discharging gate 39. The pivot 48 hardly causes power loss relative to the disk 5 due to very little relative movement at the supporting surface.

Figure 3:
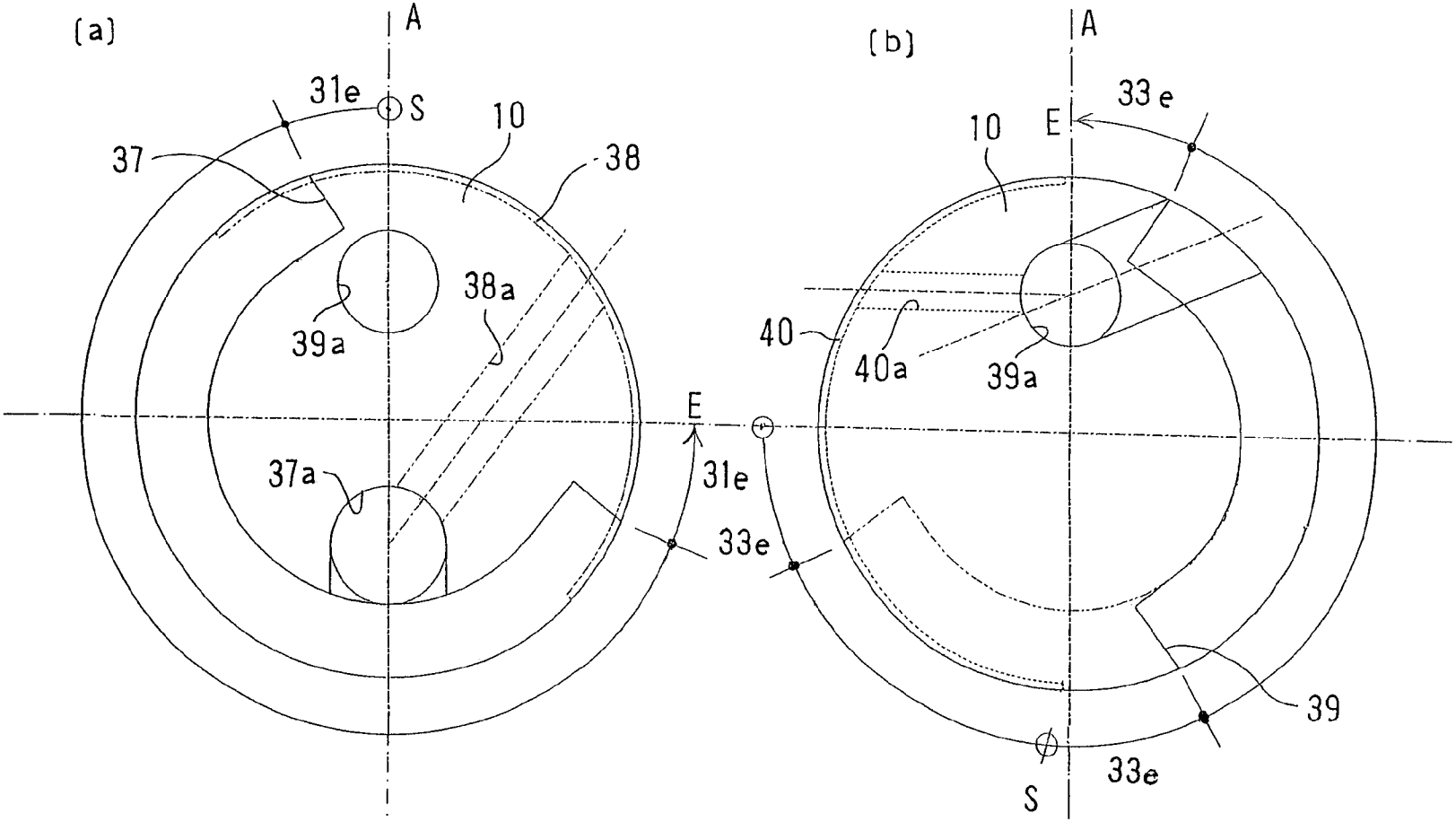
FIGS. 3(*a*) and 3(*b*) are cross sections showing supplying/discharging gates relative to a stationary abutment line respectively.

Now, the arc-slotted supplying/discharging gates 37 and 39 in the gate member 10 are described in more details. FIGS. 3(*a*) and 3(*b*) show cross sectional views of the supplying gate 37 and the discharging gate 39 at an enlarged scale respectively. As described earlier, the gate member 10 is provided with the arc-slotted supplying and discharging gates 37 and 39 that timely open and close the supplying/discharging through holes leading to the variable capacity compartments. The supplying and discharging gates 37 and 39 communicate with the supplying and discharging channels 37*a* and 39*a*. The counter windows 38 and 40 in shallow slot form are made on each opposite side of the arc-slotted supplying gate 37 and discharging gate 39 to receive the respective fluid pressure via associated pressure channels 38*a* and 40*a*. The window 38 is so determined in respect of its depth and angular extension that it can counteract and balance the component of supplying the fluid pressure applied laterally to the gate member 10 from the supplying gate 37. Likewise, the counter window 40 is so determined in its depth and angular extension that it can counteract and balance the component of discharging the fluid pressure applied laterally to the gate member 10 from the discharging gate 39. If occasion demands, two or more counter windows 40 may be formed. Thanks to these counter windows 38 and 40, an annular gap between the inner circumference of the cylindrical disk axle 23 and the outer circumference of the gate member 10 can be maintained to be equal all over the confronting circumference. The magnetic fluid seal if used, will make up the supplying gate 37 and the associated counter window 38 as a single supplying block, suppressing an invasion of the fluid pressure from the discharging side while maintaining the annular gap.

As described above, the arc-slotted supplying gate 37 extending circumferential direction can communicate with the supplying through hole 31 responsive to the rotation of the disk 5. As seen from FIG. 3(*a*), which shows a cross sectional view of the arc-slotted supplying gate 37 for the case that the disk 5 rotates counterclockwise, the supplying gate 37, where a half wing of the partition plate 7 passes through, can span the maximum rang of 0 to 270 degrees from an angular position S that is equal to the stationary abutment line A to an angular position E excluding arc length 31*e* that is equal to the radius of the supplying through hole 31 from each end of the 270 degree range.

The arc-slotted discharging gate 39 extending circumferential direction can communicate with the discharging through hole 33 responsive to the rotation of the disk 5. As seen from FIG. 3(*b*), which shows a cross sectional view of the arc-slotted discharging gate 39, the discharging gate 39, where a half wing of the partition plate 7 passes through, can span the maximum range of 0 to 270 degrees from the angular position S defined by required fluid compression ratio to a position E that is equal to the stationary abutment line A excluding arc length 33*e* that is equal to the radius of the discharging through hole 33 from each end of the 270 degree range. The discharging gate 39 has a depressing notch formed on each end of the arc slot to assure the smooth variation in pressure. The supplying gate 37 is also equipped with same pressure-smoothing means.

Figure 4:
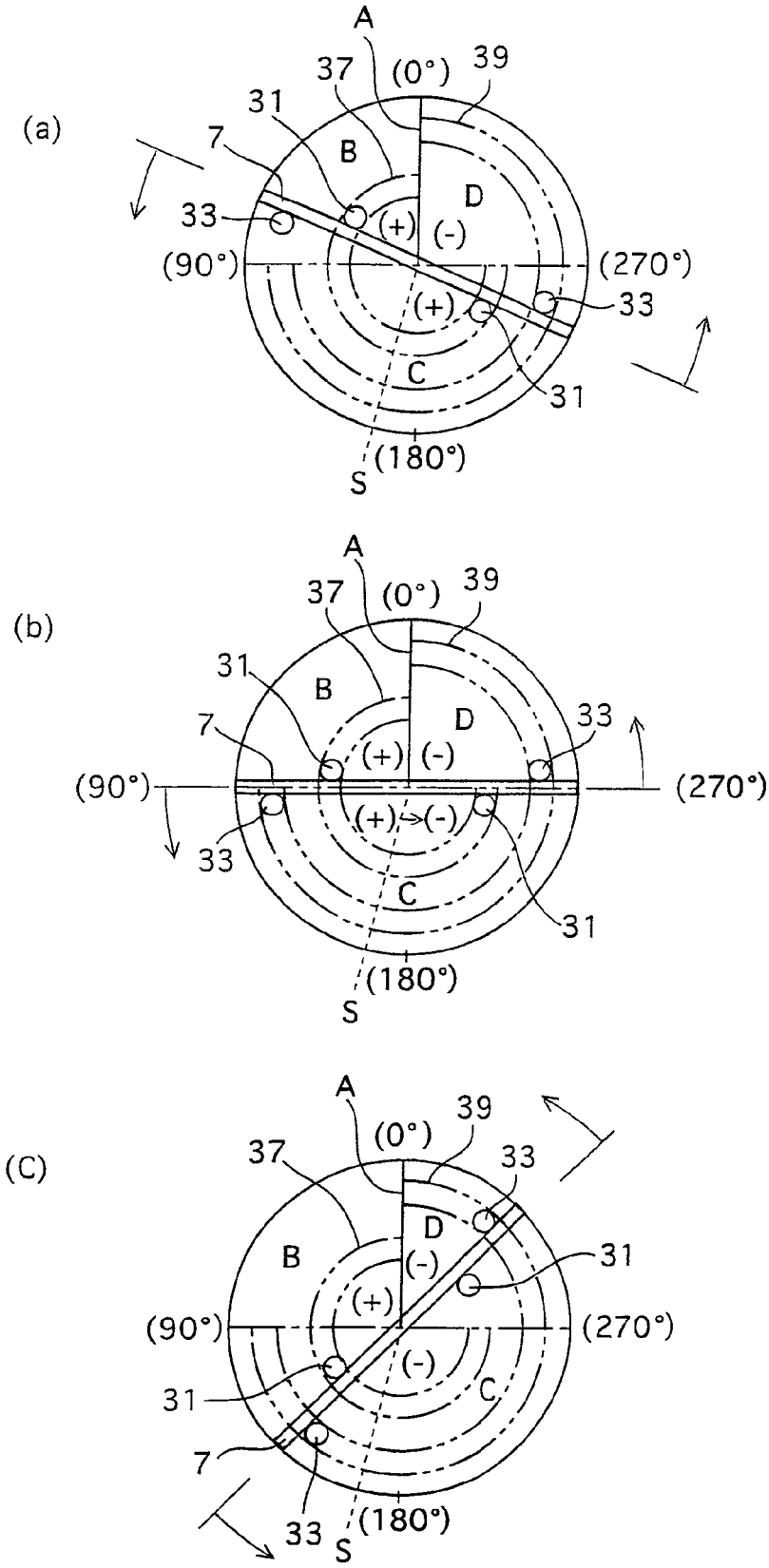
FIGS. 4(*a*), 4(*b*) and 4(*c*) illustrate relative positions of rotating variable capacity compartments and the supplying/discharging gates.

The manner in which the swash plate type variable capacity pump 1 works is described below:

As described above, the swash plate type variable capacity pump 1 has closed spaces defined by the cone 3, the disk 5, and the partition plate 7 abutting each other in the enclosure wall 9, all of which are rotatably supported in the housing 11, thus the closed spaces can change their angular position as the cone 3 rotates about its axle. Three closed sector spaces B, C and D defined by the stationary abutment line A (compartment defining means) and the partition plate 7 (compartment defining means) changes in their capacity, thereby functioning as variable capacity compartments B, C, and D (swash plate type variable capacity compartments) as illustrated in FIGS. 4(*a*), 4(*b*), and 4(*c*), which are viewed from the front side of the disk 5, showing relative positions of the variable compartments and the gate slots.

More specifically, as the partition plate 7 rotates and moves away from the stationary abutment line A, the closed space B between the partition plate 7 and the abutment line A enlarges in capacity, and the closed space C on opposite side of the partition plate 7 covering the whole semicircular sector also enlarges in capacity. As the partition plate 7 moves toward the abutment line A, the closed space D reduces in capacity. The closed spaces B, C, and D changing in capacity can be observed by solid geometry method as below when angular position of the partition plate 7 which rotates counterclockwise is described on the basis of angular position of the abutment line A: Referring to FIG. 4(*b*), at the instant the partition plate 7 reaches the angular position of 90° (or 270°), the semicircular closed space C is the largest in capacity. In other words, while the partition plate 7 moves from 0° (or 180°) to 90° (or 270°), the closed spaces B and C are expanding in capacity as indicated by the sign + in FIG. 4(*a*) (expanding process), and the closed space D is reducing in capacity as indicated by the sign—in FIG. 4(*a*) (contracting process). When the partition plate 7 is traversing the angular position of 90° (or 270°), the closed space C changes from the expanding process (+) to the contracting process (−); and while the partition plate 7 rotates further 90 degrees beyond the angular position of 90° (or 270°) as shown in FIG. 4(*c*), the closed space B still follows the expanding process (+) whereas the closed spaces C and D follow the contracting process (−).

The supplying through holes 31 and discharging through holes 33 of the disk 5 are open near the partition plate 7, and the supplying/discharging gates 37 and 39 of the gate member 10 are so arranged that flow paths be formed responsive to the conditions of the closed spaces B, C, and D in operation. With this arrangement, when the partition plate 7 rotates 90 degrees past the angular position of 0° (or 180°) as shown in FIG. 4(*a*), fluid is supplied from the supplying gate 37 into the closed spaces B and C, and at the same time fluid is discharged from the closed space D into the discharging gate 39. When the partition plate 7 rotates 90 degrees past the angular position of 90° (or 270°) as shown in FIG. 4(*c*), fluid is supplied into the closed space B, and at the same time, fluid is discharged from the closed spaces C and D.

Fluid is constantly drawn into the variable capacity compartments B and C which are formed on back side of the partition plate 7, since these compartments expand in capacity as the partition plate 7 sweeps the whole 270 degree range after traversing the abutting line A. The variable capacity compartments C and D which are formed in front side of the partition plate 7 reduce in capacity as the partition plate 7 sweeps the whole 270 degree range until arriving at the abutting line A. Therefore, in case of dealing with non-compressible fluid or vacuuming, the angular range for discharging of fluid is set in the whole 270 degree up to the abutment line A, whereas in case of dealing with compressible fluid, the discharging of fluid is deferred until the partition plate 7 reaches the initial angular position S of the discharging gate 39 so as to discharge fluid at a desired compression ratio. The amount of so discharged non-compressible fluid, in fact, reaches the maximum twice for every half-rotation, resulting in continuous discharging.

The rotation of these three variable capacity compartments allows continuous pumping without using any check valve, and accordingly, the swash plate type variable capacity pump 1 can be significantly reduced in size. Still advantageously, power load is averaged, permitting the swash plate type variable capacity pump 1 to work quietly at an increased efficiency. As described above, the initial angular position S is determined to delay the timing of discharging fluid, thereby gaining a desired discharging pressure.

As may be understood from the above, all the rotary members 3, 5, 7 and 9 rotate in synchronization, thereby getting rid of any wear, which otherwise would be caused in the rubbing members, and would lower the durability particularly when constantly pumping a large amount of fluid at an increased flow rate.

In operation, the disk 5 receives the discharging pressure on the rear surface 5*c* from the discharging gate 39, thereby pushing the disk 5 in the direction toward the variable capacity compartments. Thus, a counter discharging pressure from the variable capacity compartments is suppressed, and the disk 5 and cone 3 are pressed together to keep the boundary of the variable capacity compartments fluid-tight, even under the condition that the compression ratio of fluid is high. Thanks to lesser relative movement or friction between the disk 5 and the enclosure wall 9, the dry type of fluid can be pumped in non-lubrication condition without lowering the durability. As for the gate member 10, the discharging pressure from the variable capacity compartments is applied to the end surface 45 via the discharging channel 39*a* to produce a counter force, which is applied to the rear surface 5*c* of the disk 5 via the inner circle of the gate member 10 and the associated bearing to push the disk 5 in the direction toward the variable capacity compartments. This counter force can be selectively increased as the occasion demands.

Figure 5:
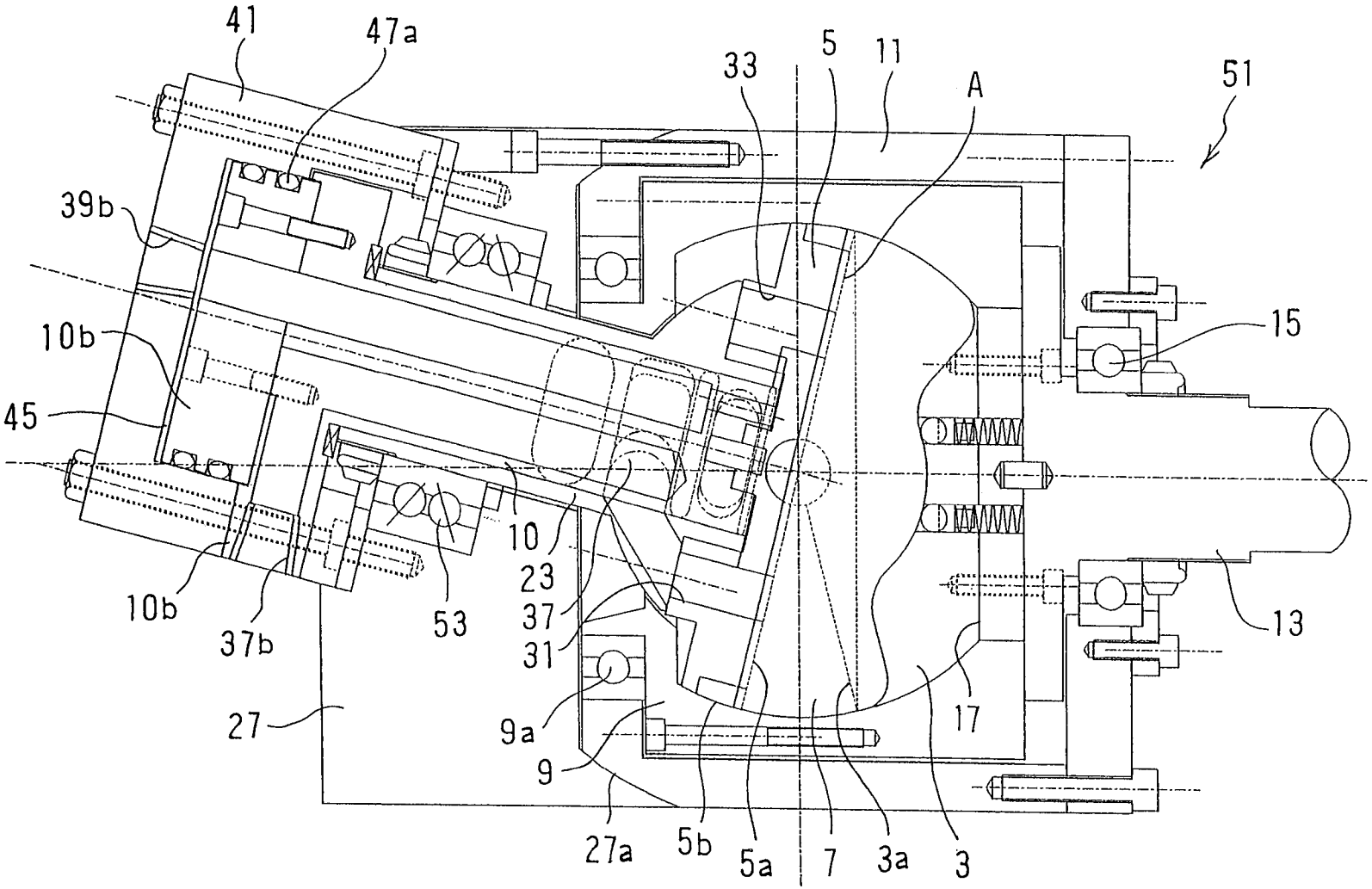
FIG. 5 is a longitudinal section of a swash plate type variable capacity fluid machine according to another embodiment of the present invention, which is appropriate for pumping a relatively large quantity of fluid.
Figure 6:
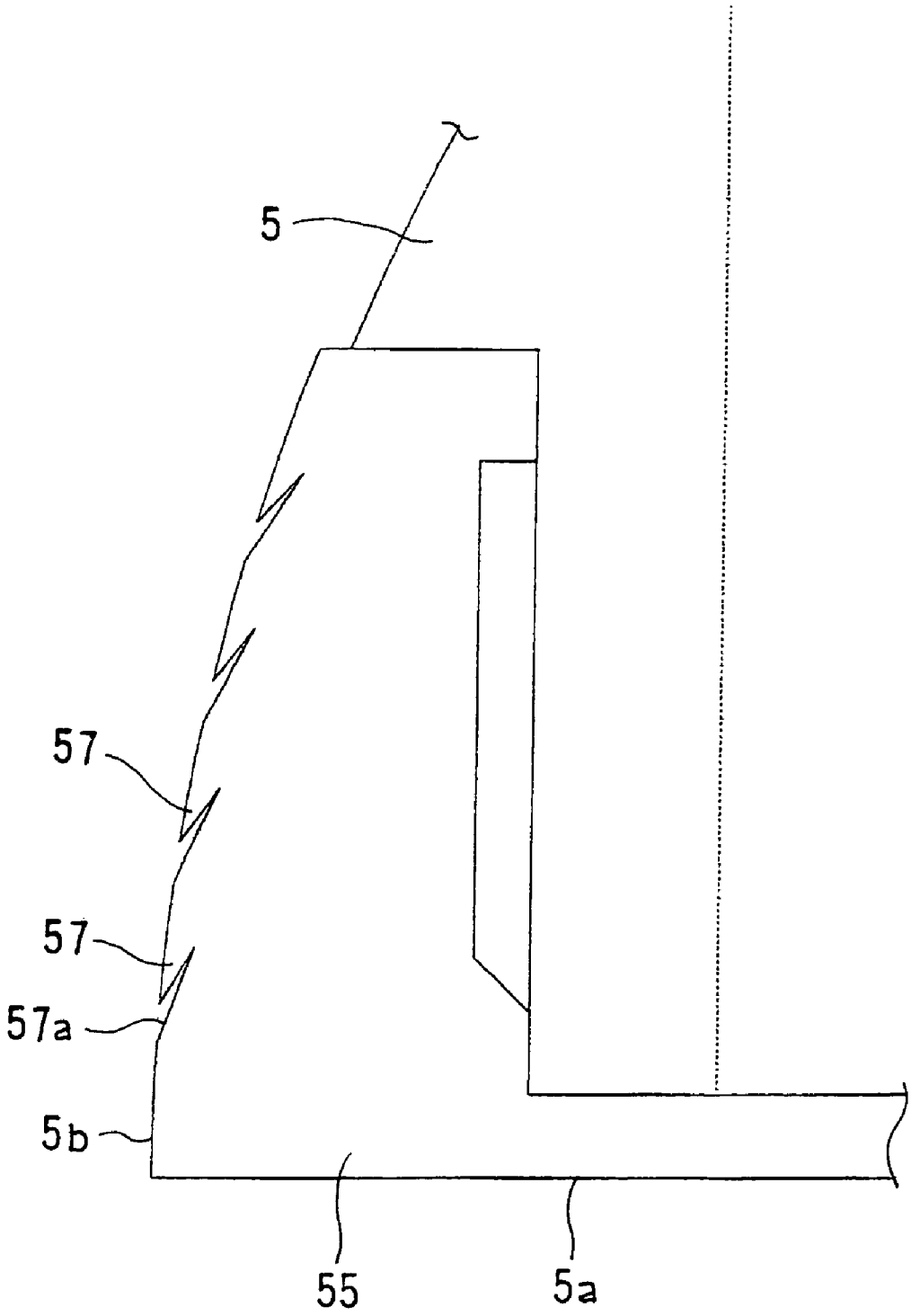
FIG. 6 is an enlarged sectional view of a sliding member.

FIG. 5 shows a swash plate type variable capacity pump 51 according to another embodiment of the present invention, which is appropriate for pumping large quantities of fluid under high compression ratio. It comprises same components as the above described swash plate pump 1. The same components are indicated by same reference numerals, and their description is omitted. The disk 5 has a sliding member 55 attached to its circular disk surface 5*a* and outer circumference 5*b*. The sliding member 55 is made of a resilient synthetic resin whose friction coefficient is relatively low. Otherwise, the disk 5 may be coated with such resin materials. The resin material has a resiliency snugly enough to fit on the conical surface 3*a* of the cone 3. As seen from FIG. 6, the sliding member 55 has a plurality of resilient lips 57 formed on its entire circumference, facing a confronting spherical surface of the enclosure wall 9 at a sharp angle. Specifically, each resilient lip 57 is formed by cutting the circumference of the sliding member 55 in the form of "V" sloping toward the normal line as indicated by 57*a*. The resilient lips 57 can be provided in several lines, depending on the fluid pressure. The resilient lips 57 are yieldingly responsive to the fluid pressure invading from the variable capacity compartments along the outer circumference 5*b*, and expand to seal the annular gap between the disk 5 and the enclosure wall 9. The disk axle 23 is rotatably supported by an ungula roll bearing 53, which can well resist to radial load while applying a predetermined pressure toward the variable capacity compartments.

The gate member 10 has a large diameter end 10*b*, which, in turn, has two "O"-rings 47*a* fitted on its circumference. With this arrangement, the disk 5 can well resist a relatively strong counter force when operating at an increased compression rate, assuring that the disk 5 be pressed against the cone 3 along the abutment line A with a predetermined force.

Figure 7:
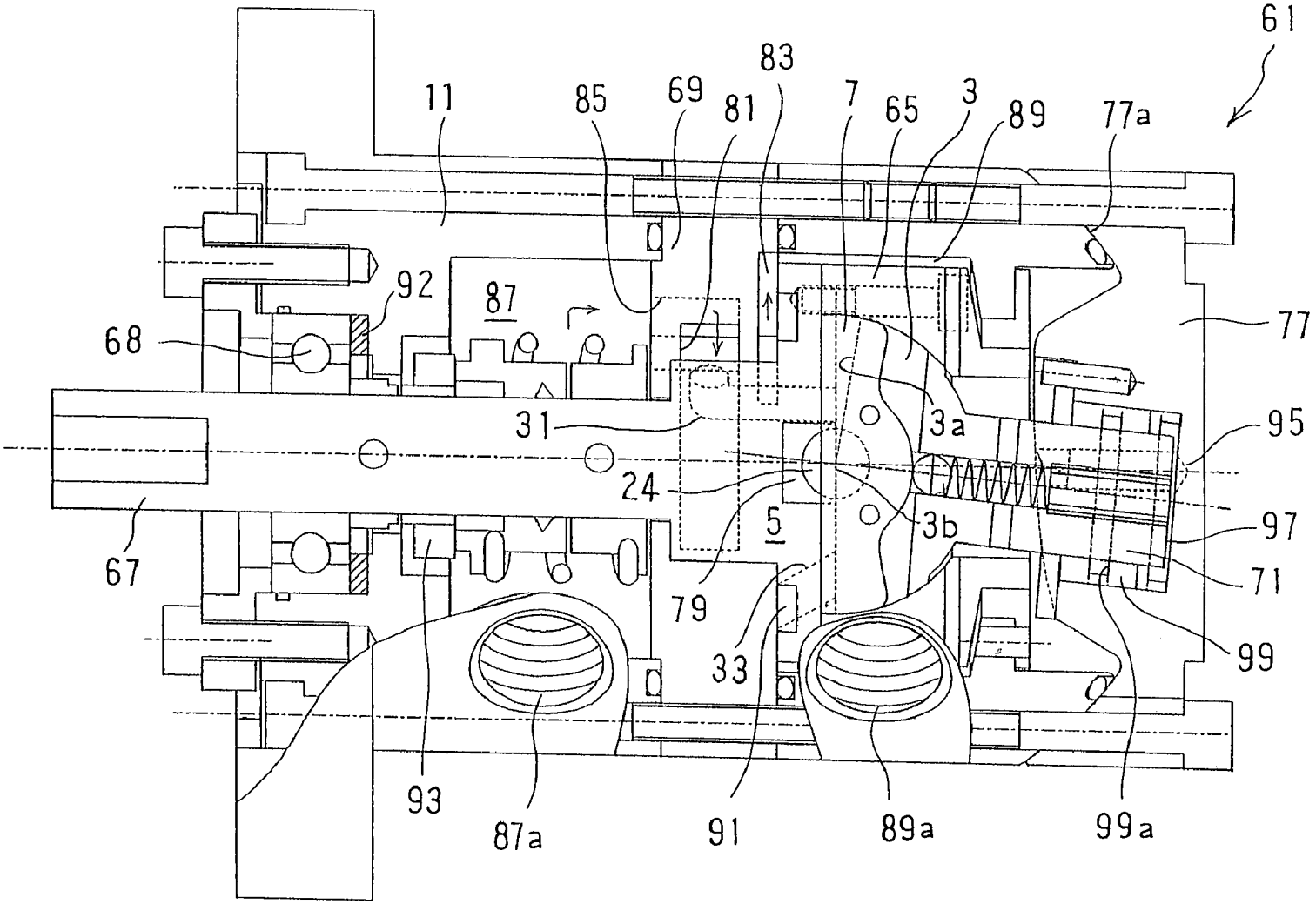
FIG. 7 is a longitudinal section of a swash plate type variable capacity fluid machine according to still another embodiment of the present invention, which is appropriate for pumping incompressible fluid.
Figure 8:
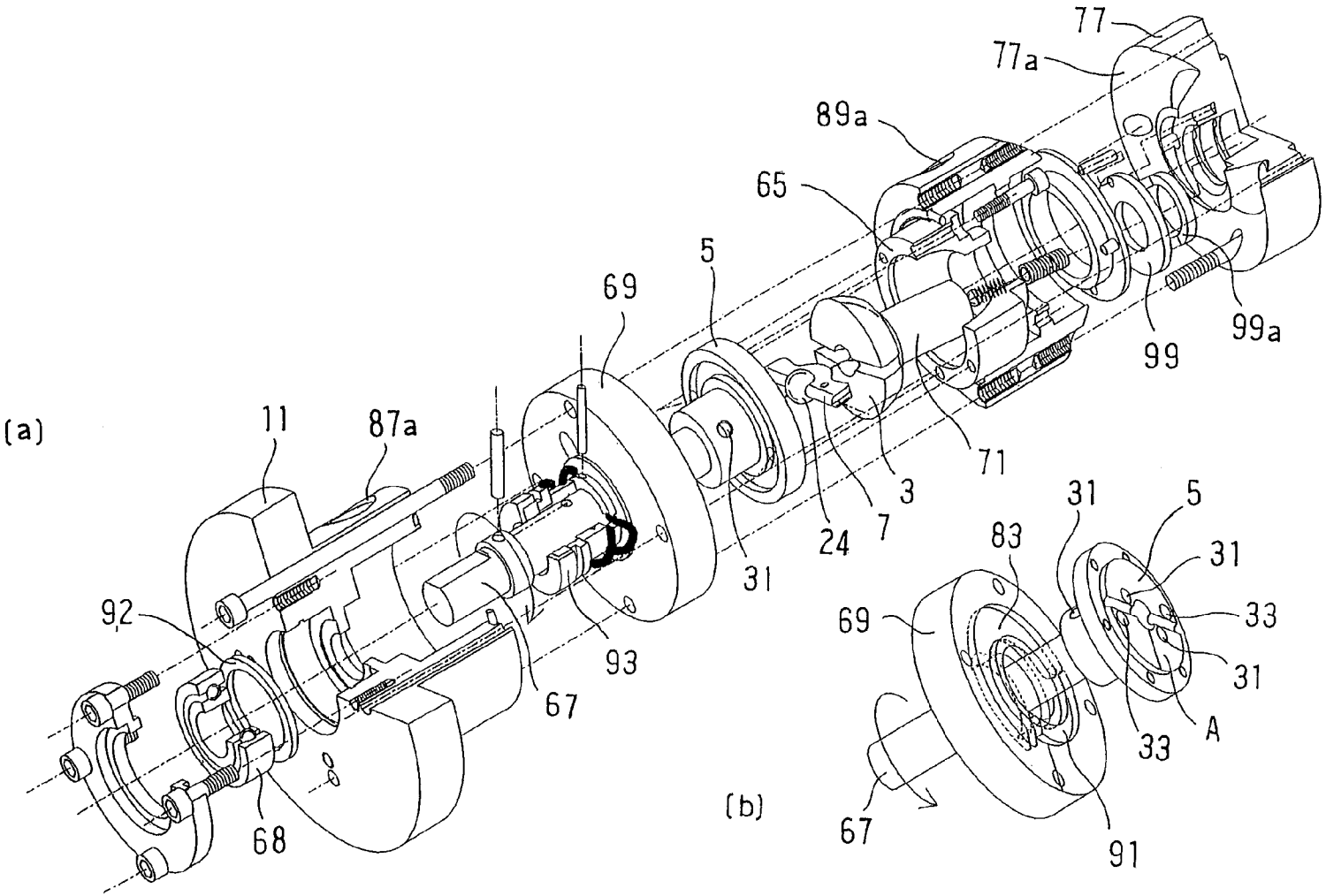
FIG. 8(*a*) is an exploded view of the fluid machine of FIG. 7, and FIG. 8(*b*) is a perspective view of one rotary part of the fluid machine as viewed in the opposite direction.

A swash plate type variable capacity pump 61 according to still another embodiment of the present invention as shown in FIGS. 7 and 8 is appropriate for pumping uncompressible fluid. As seen from these drawings, the swash plate type variable capacity pump 61 has its disk 5 integrally connected to an enclosure wall 65, in which the cone 3 and the partition plate 7 can rotate about the crossing axes with the disk 5. These members are all rotatably supported in the housing 11. The disk 5 is rotatably supported by a roll bearing 68 and a stationary gate member 69 provided in a power axle 67 which extends on the rear side of the disk 5 for power input. The enclosure wall 65 has its semicircular surface defined therein with the center on the cone tip 3*b*. The opposite sides of the partition plate 7 can move on the diameter line of the cone 3, and its opposite ends slidably abut on the spherical surface of the enclosure wall 65. The cone 3 has a cone axle 71 rotatably supported in a support block 77.

The disk 5 has a ball seat 79 press-fitted in its center recess. The ball seat 79 is made of a synthetic resin of low-friction, low-thermal expansion, and low-moisture absorption, and it has a semicircular center recess to accommodate a ball 24. The ball seat 79 prevents metal-to-metal contact between the center ball 24 and the disk 5, and at the same time assures that the disk 5 be put in correct position relative to the confronting cone 3.

Figure 9:
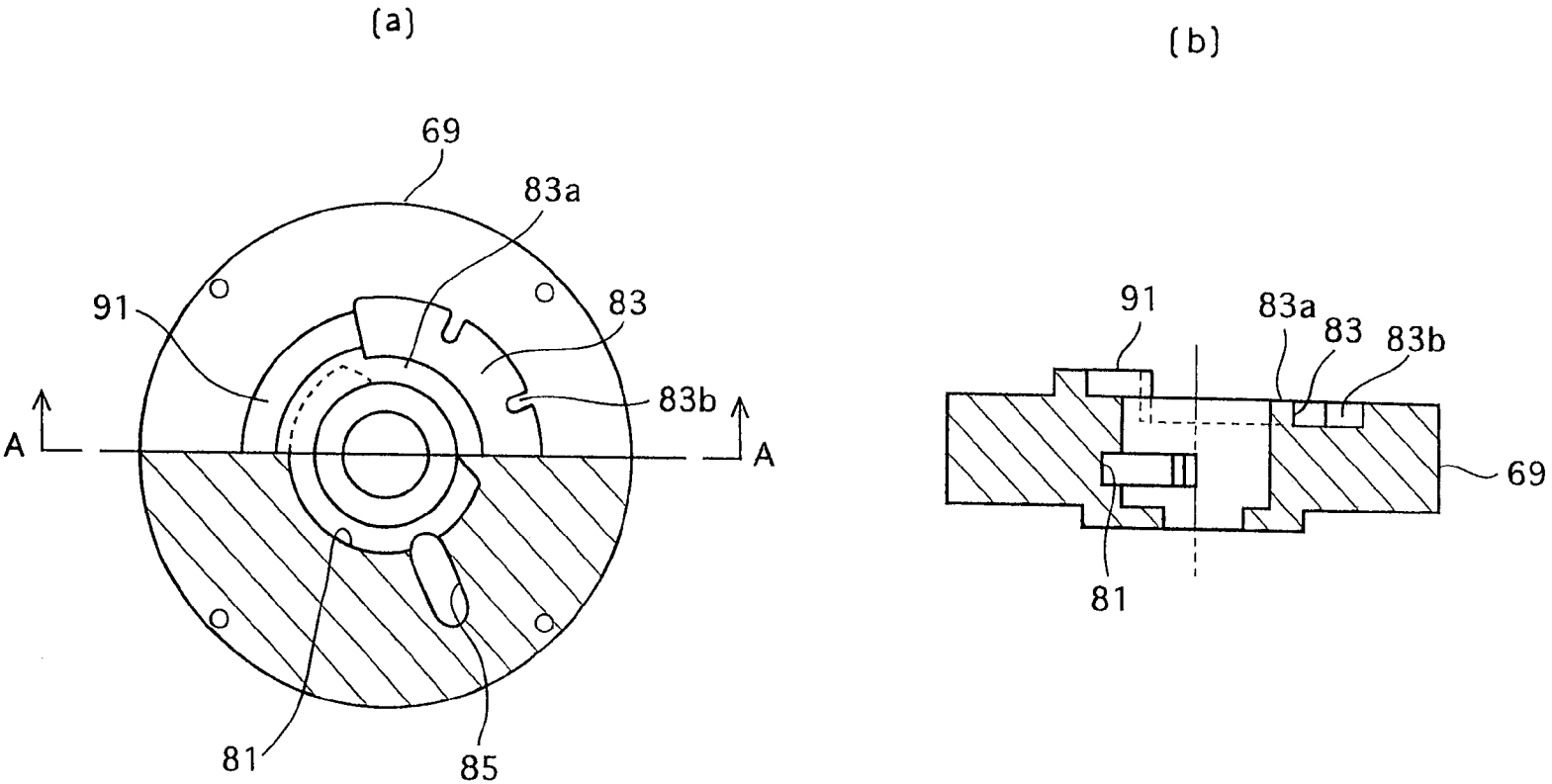
FIG. 9(*a*) is an enlarged view of a gate member as viewed on the front side whereas FIG. 9(*b*) is a cross section of the gate member taken along the line A-A in FIG. 9(*a*)

The stationary gate member 69 has a supplying gate 81 made in the form of slot spanning a predetermined angular range on the inner radial surface of the stationary gate member 69 and a discharging gate 83 made in the form of slot spanning another predetermined angular range on the front thrust surface of the gate member 69. The supplying and discharging gates 81 and 83 can communicate with the supplying through hole 31 and discharging through hole 33 respectively every time the disk 5 rotates respective predetermined angles: the supplying through holes 31 are open to the inner radial surface of the stationary gate member 69 whereas the discharging through holes 33 are open next to an annular plateau 91 of the gate member 69. The supplying gate 81 communicates with a supplying room 87 via a supplying channel 85. The outer circumference of the discharging gate 83 communicates with a discharging room 89 on the outer circumference of the enclosure wall 65. As seen from FIGS. 9(*a*) and 9(*b*) (front view and cross section taken along the line A-A respectively), thrust supports 83*a* and 83*b* are formed on the opposite sides of the discharging gate 83 to abut the confronting disk 5, thereby holding it in a state of equilibration. The annular plateau 91 effectively prevents fluid leak from the variable capacity compartments via the discharging through holes 33 on the disk 5. The supplying room 87 and the discharging room 89 are provided with a supplying port 87*a* and a discharging port 89*a* respectively on their outer circumferences.

The power axle 67 is rotatably supported to the housing 11 via the roll bearing 68, and is fixedly held to the housing 11 via a shim 92, and the supplying room 87 is sealed by a mechanical spring seal 93. The support block 77 has a pressure channel 95 made therein, allowing application of the discharging pressure from the discharging room 89 to an end surface 97 of the cone axle 71, thereby producing a counter force to push back the cone 3 toward the disk 5 along the axis of the cone axle 71. Also, a bush 99 around the cone axle 71 has windows 99*a* communicating with the pressure channel 95. These windows 99*a* are so determined in size and angular positions that the resultant radial force caused by the discharging pressure may be applied to the cone axle 71 to effectively oppose to undesired inclining moment, which forces the cone axle 71 to deviate from the correct oblique position. The mounting surface 77*a* of the support block 77 takes the spherical shape corresponding to the part of the sphere whose center is on the cone tip 3*b*, thereby making it possible to adjust the center axis of the cone 3 relative to the center axis of the disk 5.

In the swash plate type variable capacity pump 61 arranged as described above, the disk 5 is integrally connected to the enclosure wall 65 to rotate together as a whole. Therefore, the enclosure wall 65 can be simply constructed in an exact hemispherical shape. Still advantageously, the partition plate 7 slides on the enclosure wall 65 in much smaller area, resulting in an improvement of durability.

Figure 10:
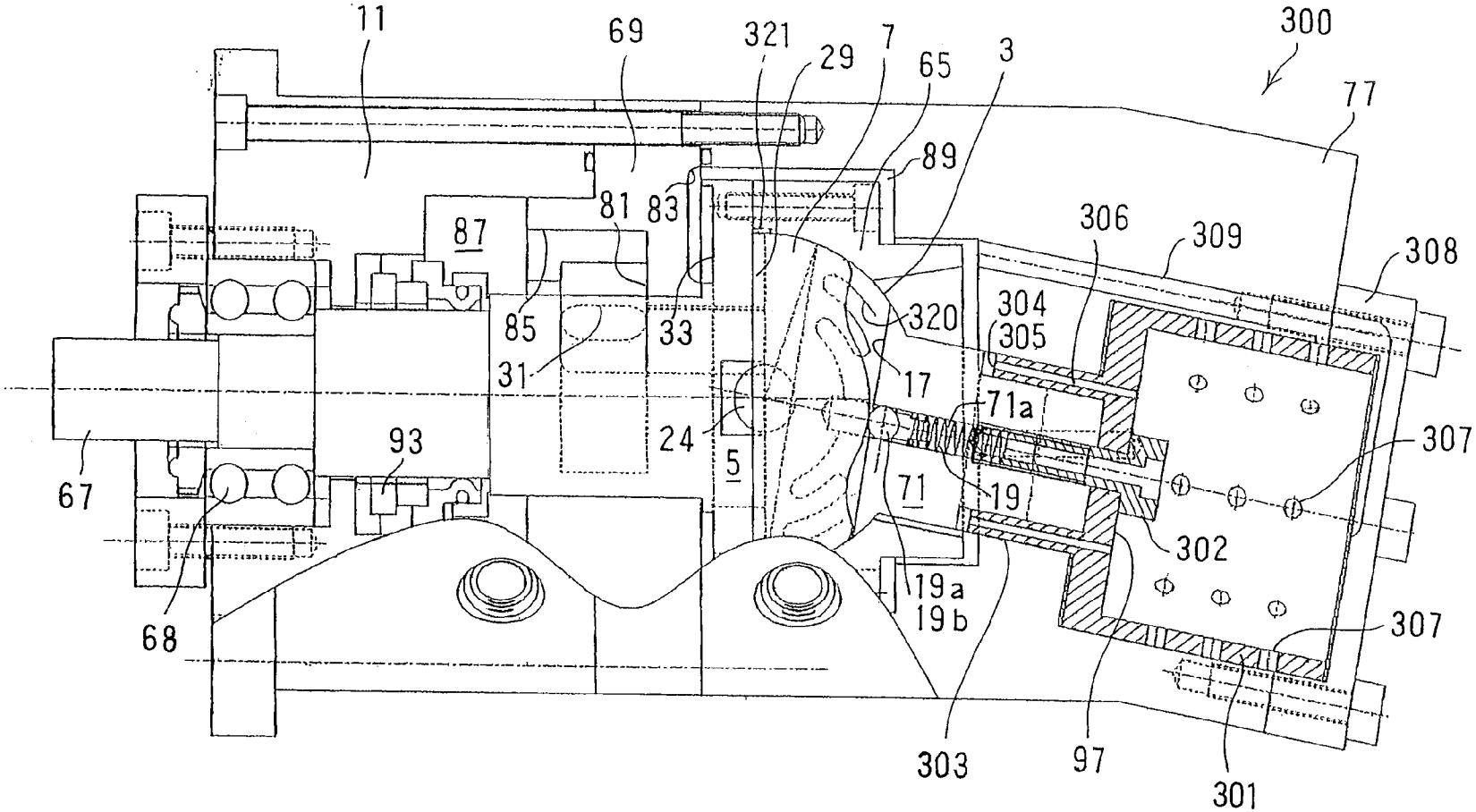
FIG. 10 is a longitudinal section of a swash plate type variable capacity fluid machine according to still another embodiment of the present invention.

Alternative examples of the cone 3 for use in the swash plate type variable capacity pump which is appropriate for pumping uncompressible fluid such as water is described hereafter. A swash plate type variable capacity pump 300 as shown in longitudinal section in FIG. 10 has a cylinder axle 301 tightly bolted to the rear cone axle 71 by driving a headed hollow bolt 302 in a center tapped hole 71*a* running through the cone axle 71. The cylinder axle 301 has an integrally constructed neck 303, which encircles the rear cone axle 71, and is rotatably supported in the support block 77. The cylinder axle 301 is further provided with an annular conduit 306, which leads from hollow center of the cylinder axle 301 to a slot 305 of a tiered gap 304 the in the rear cone axle 71. Also, the cylinder axle 301 has a plurality of through holes 307 made at regular intervals in its entire cylindrical surface, whereby letting fluid run through. A pressure channel 309 is provided in the support block 77 to communicate with the end of the cylinder axle 301, which is closed with a cover plate 308.

With this arrangement, the cone 3 is exposed on the end surface 97 of the cone axle 71 to the increased pressure from the hollow center of the cylinder axle 301, thereby countering the thrust force from the variable capacity compartments. The cone axle 71 is held by the cylinder axle 301, which is suspended by fluid jet flushing from the through holes 307 into the annular gap between the cylindrical surface and the surrounding wall of the support block, thus constantly holding the cone axle 71 at its correct oblique position while lubricating and cooling all the cylindrical surface of the cylinder axle 301. As may be understood, the swash plate type variable capacity pump 300 can be simply constructed with relatively large annular gap, still assuring that the cone axle 71 be held in exact oblique position while suppressing generation of heat.

Figure 11:
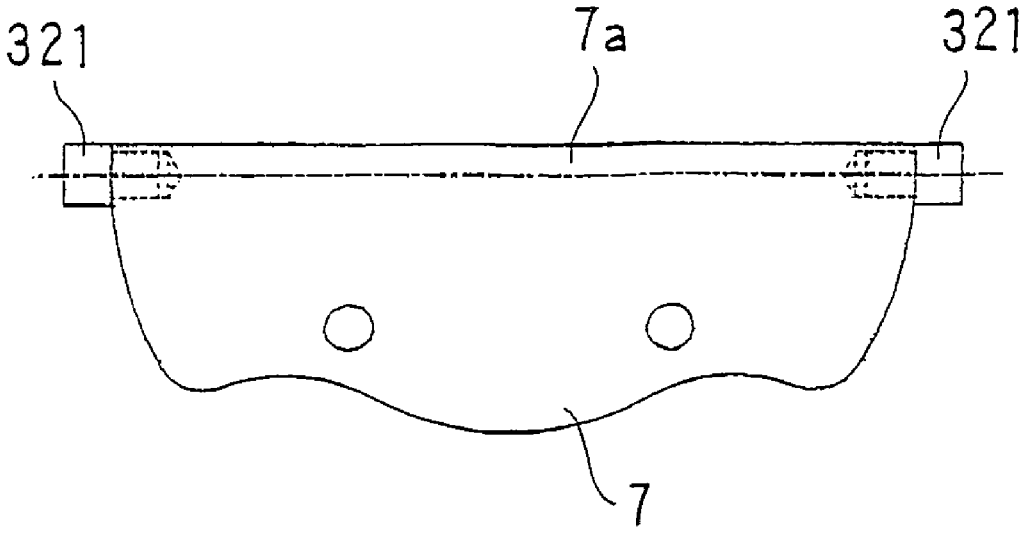
FIG. 11 is an enlarged view of a partition plate used in the fluid machine of FIG. 10.

The cone axle 71 has a center hole 71*a*, in which a hollow bolt 302 and a spring 19 on top of the hollow bolt 302 are provided. The spring 19 pushes the partition plate 7 in the direction of the disk 5 via a spring-biased ball 19*a* and a ball seat 19*b*. The center hole 71*a* communicates with the end surface 97 which receives the discharging pressure, and shallow recesses 320 are made inside of the groove 17 of the cone 3 to retain fluid for lubrication. With this arrangement, the partition plate 7 can be lubricated and pressurized. The partition plate 7 is provided with two axes 321 on its opposite sides, thereby being supported in the enclosure wall 65. Specifically, the axes 321 are provided on the opposite ends of a rounded upper edge 7*a* of the semicircular partition plate 7 as described in FIG. 11, fixed by a press fitted pin in the rounded upper edge 7*a*. The so arranged partition plate 7 is put in contact with the confronting disk 5 with the rounded edge 7*a* fitted in the engagement groove 29 as it swings, thereby allowing the variable capacity compartments to be fluid-tight.

With a view to providing same advantages, the above described structure can be equally adopted to any swash plate type fluid machines such as a hydraulic motor capable of converting pressurized fluid dynamic to rotary power. The structure of establishing an abutment line between a conical body and a disk body as described above can be equally applied to swash plate type fluid machines which consist of variable capacity compartments defined by an abutment line between a cone-and-disk bodies and at least one radius-length partition vane. The other characteristics of the swash plate type variable capacity fluid machine according to the present invention as described above can be equally adapted to swash plate type fluid machines which consist of variable capacity compartments defined by plurality of radius-length partition vanes. Therefore, further descriptions of these types of fluid machines are omitted.

The swash plate type variable capacity fluid machine according to the present invention can be reduced to practice as follows:

(1) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of a plurality of radius lines on the disk surface; characterized in that: the partitioning means selectively comprises a plurality of radius-length partition plates movably fitted in grooves of the conical body and an abutment line formed between the conical body and the disk body on their confronting surface; pressure channels are formed to deliver an increased pressure from the variable capacity compartments; and at least one of the conical body and the disk body has a pressure-exposed area on its rear side to receive the increased pressure from the pressure channels in direction of the variable capacity compartments. With this arrangement, the increased pressure delivered from the variable capacity compartments to the rear side of the conical or disk bodies suppress a reactive force caused by the increased pressure in the variable capacity compartments and applied to the conical or disk bodies, thereby preventing the conical and disk bodies from moving apart. Therefore, friction and wear problems can be significantly reduced with the present invention, thereby improving the durability of the fluid machine, and also permitting wide range of fluids be applied. Also advantageously, the conical and disk bodies are so firmly abutted on each other that the fluid-tightness of the variable capacity compartments can be increased.

(2) At least one of the conical and disk bodies described above is provided with supplying/discharging through holes and a cylindrical rear axle integrally connected and concentrically extending on its rear side. A stationary cylindrical gate member is movably fitted in a hollow center of the rear axle. The gate member consists of supplying/discharging channels to communicate with the supplying/discharging through holes every time the rear axle rotates a predetermined angle, and forms the pressure-exposed area as mentioned above on its inner end surface to receive the increased discharging pressure. With this arrangement, the fluid in the variable capacity compartments is delivered through the gate member movably fitted in the hollow center of the rear axle via the supplying/discharging through holes of the disk body into the hollow center space, where the inner end surface receives the pressure which pushes the rear axle toward the variable capacity compartments. Therefore, undesired reactive force from the variable capacity compartments can be suppressed, at the same time constructing the gate member in a telescopic shape.

(3) In the structure of Paragraph (2), the gate member is fixed to the rear axle via a thrust bearing; an axle end room is defined next to the outer end surface of the gate member, which is adapted to be exposed to the increased pressure. With this arrangement, the suppressing force proportional with the area of the outer end surface can be produced to be applied onto the rear axle, cooperating with the suppressing force applied to the inner end surface of the gate member. Thus, the undesired reactive force from the variable capacity compartments can be effectively suppressed by the resultant suppressing force, which permits the substantial increase of discharging force in the fluid machine.

(4) In the structure of Paragraph (1), at least one of the conical and disk bodies is provided with the supplying/discharging through holes and the cylindrical rear axle integrally connected and concentrically extending on its rear side. The stationary gate member consists of: long-slotted supplying/discharging gates that are movably fitted in the rear axle and controllably communicates with the rear axle; and supplying/discharging channels that communicate with the supplying/discharging through holes via the supplying/discharging gates. Either one of the supplying/discharging channels being prevailed with the increased pressure extends to the outer end surface of the rear axle to form a pressure exposed area. With this arrangement, the increased pressure is delivered from at least one of the conical and disk bodies through the gate member to generate suppressing force from the rear side of the rear axle, thereby effectively preventing the cone-and-axle body from floating up while allowing the gate structure with high degree of freedom.

(5) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of a plurality of radius lines on the disk surface; characterized in that: the partitioning means selectively comprises a plurality of radius-length partition plates movably fitted in grooves of the conical body and an abutment line formed between the conical body and the disk body on their confronting surface; the disk body has a center ball, which is concentric with the circular disk surface and rotatably supports the conical body and the partition plates toward the disk body. The center ball placed in the center of the disk body positions and supports the conical body and the partition plates relative to the disk body, thereby reducing friction load on the enclosure wall even when undesired deviating force is applied to the rotary members, and also assuring that the conical and disk bodies closely abut along the abutment line in fluid-tight condition.

(6) In the structure as described in Paragraph (5), at least one of the conical and disk bodies has a resin ball seat to accommodate the center ball. The ball seat is made of a resin material of low friction and low thermal expansion. With this arrangement, the center ball and the conical or disk body do not directly contact each other, thereby improving durability of these members especially when made of metal. At the same time, it is possible to reduce the ball-surrounding gap to minimum, which contributes to the improvement of the sealing effect in the variable capacity compartments.

(7) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of one or more radius lines on the disk surface; characterized in that: the partitioning means selectively comprises one or more radius-length partition plates movably fitted in grooves of the conical body and an abutment line formed between the conical body and the disk body on their confronting surface; and at least one of the conical and disk bodies has a resilient resin coating on its surface. The resilient resin coating allows effective fitting of the conical body of metal material on the abutment line even in the case that the center lines of the conical and disk bodies do not cross at the exact angle. Thus, a required fluid-tightness can be assured along the abutment line.

(8) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of a plurality of radius lines on the disk surface; characterized in that: the partitioning means selectively comprises a plurality of radius-length partition plates movably fitted in grooves of the conical body and an abutment line formed between the conical body and the disk body on their confronting surface; and one of the spherical enclosure surface and the confronting body surface has resilient lips (dam body) expandable in response to the running fluid caused by pressure differential between the variable capacity compartments and its exterior spaces. With this arrangement, fluid-leaks through the sliding surface can be blocked at the same time of obtaining fluid membrane on the sliding surface. Thus, an improved fluid-tightness can be assured along the sliding surface, thereby obtaining large pressure difference between the variable capacity compartments and its exterior spaces.

(9) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of a plurality of radius lines on the disk surface; characterized in that: the partitioning means selectively comprises a plurality of radius-length partition plates movably fitted in grooves of the conical body and an abutment line formed between the conical body and the disk body on their confronting surface; and the disk body integrally connected to the enclosure wall is provided with a drive mean to rotate the conical and disk bodies about their center axes in synchronization. With this arrangement, the disk body rotates in synchronization with the conical body and the partition plate, thereby reducing relative speed between the disk-and-enclosure wall assembly and the partition plates. The variable capacity compartments are defined by the enclosure wall and the partition plates, since the conical body and the partition plates move in the hemispherical space surrounded by the enclosure wall and the disk body. Thus, the partition plates are improved in its fluid tightness and durability. Furthermore, the movement of the conical body on the enclosure wall is limited within the hemispherical space surrounded by the enclosure wall and the disk body, effectively facilitating the construction of the enclosure wall.

(10) A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; and partitioning means for dividing the space between the conical body and the disk body into a plurality of variable capacity compartments in respect of a plurality of radius lines on the disk surface; characterized in that: the partitioning means selectively comprises a plurality of radius-length partition plates movably fitted in grooves of the conical body and an abutment line formed between the conical body and the disk body on their confronting surface; rotary members rotating along with the partition plates has supplying/discharging through holes made therein, which are open to the variable capacity compartments; a gate member is provided with supplying/discharging slotted gates spanning predetermined range, thereby communicating with the supplying/discharging holes; and supplying/discharging channels communicate with the gate member. With this arrangement, supplying/discharging of fluid is controlled to be timely performed in accordance with the rotation angle of the partition plates and the relative angular positions of the supplying/discharging slotted gates. This results in preventing pressure loss at supplying side and adjusting pressure level at discharging side, thereby improving efficiency of the supplying/discharging actions.

(11) In the structure as described in Paragraph (10), the disk body has radial grooves made on its circular disk surface to fit in the rounded edges of the partition plates, and the disk body has the supplying/discharging through holes also opened on the disk surface. With this arrangement, the disk body can rotate along with the conical body by means of the partition plates while supplying and discharging the fluid through the supplying/discharging through holes on the disk body. Therefore, supplying/discharging through holes can be easily constructed on the structure of the disk body.

(12) In the structure as described in Paragraph (10), the gate member is placed to encircle the conical and disk bodies so that the supplying/discharging through holes of the rotary body may communicate with the supplying/discharging gates of the surrounding gate member whenever they come to be aligned in rotation. This arrangement provides the advantage of significantly increasing the freedom of positioning supplying/discharging channels in designing. The channeling, therefore, can be designed to meet the requirement of handling an increased amount of fluid under relatively small hydraulic pressure difference.

(13) In the structure as described in Paragraph (10), one supplying/discharging slotted gate is made on a thrust surface of the gate member, perpendicular to the center axis of the rotary body, and the supplying/discharging slotted gate being open to the annular gap defined between the enclosure wall and the surrounding housing. The annular gap can be easily made to provide a desired pressure gradient toward the supplying/discharging port, not allowing any leak from the gap between the rotary enclosure wall and the stationary housing.

(14) In the structure as described in Paragraph (10), a cylindrical rear axle is integrally and coaxially connected to the rear side of one of the conical and disk bodies provided with the supplying/discharging through holes, and is rotatably supported. A stationary cylindrical gate member is telescoped in a hollow space of the rear axle, leaving the annular gap there between. The gate member is provided with the supplying/discharging channels that communicate with the supplying/discharging through holes in response to the rotation angle of the rear axle. The gate member is supported to follow the movement of the center axis of the rear axle by an associated floating support member of elastic material. This arrangement of the gate member provides an advantage of easy mounting of the gate member in the rear axle with a margin of errors in assembling the rear axle to the housing, thereby preventing fluid leak thanks to small gap about the supplying/discharging through holes, and at the same time improving durability of the sliding members with less/no contact opportunity.

INDUSTRIAL APPLICABILITY

The claimed swash plate type variable capacity fluid machine provides the advantages as follows:

In operation, the variable capacity compartments are defined within the spherical enclosure wall by the partitioning means, and a relative displacement of the compartments causes fluid to be supplied and discharged, or the supplying and discharging of fluid cause the compartments to be relatively displaced. Then, the disk body and enclosure wall integrally constructed rotate along with the conical body and the partition plate in synchronization by the synchronous mechanism, thereby reducing the relative speed between the enclosure wall and the partition plate. Consequently, the partition plate can be improved in its fluid tightness and durability. With this claimed structure, the rotation of the conical body is limited within the hemispherical space facing the disk body in the enclosure wall, and therefore, the fluid machine can be easily constructed with a simple hemispherical structure of the enclosure wall.

In the structure with the conical body having the rear axle extending along its center axis on the rear side, and its end surface forming the pressure-exposed area, the increased pressure from the variable capacity compartments is applied onto the end surface of the rear axle via pressure channels to act as the counter force against the pressure from the variable capacity compartments, thereby preventing the conical body from leaving apart from the confronting disk body. Further advantageously, this arrangement allows improvement of durability and expansion of the applicable fluid thanks to the modified sliding structure, at the same time effectively keeping both the conical and disk bodies abut on each other along the radial abutment line in fluid-tight condition.

With the structure that the end surface of the rear axle is supported by the cylindrical axle provided with the through holes, the fluid is permitted to radially eject from the through holes making the cylindrical axle self-centered with its centripetal force, thereby sustaining the rear axle about the center axis. The ejecting fluid that lubricates and supports the rear axle further has a cooling effect of the rear axle on its all circumference. This arrangement has further advantages that it allows to have a relatively large annular gap, which allows cooling as well as centering of the rear axle with high precision.

With the structure that the disk body has the supplying/discharging through holes open at its circular surface and the gate member is associated therewith for supplying/discharging of fluid, communication between the variable capacity compartments and the supplying/discharging channels is controlled in respect of predetermined angular positions of the gate member.

This arrangement has further advantages that it allows effective supplying/discharging of fluid with very little loss by controlling the angular positions of the gate member to communicate with the supplying/discharging channels, and further allows a quiet operation.

The invention claimed is:

1. A swash plate type variable capacity fluid machine for supplying and discharging applied fluid comprising: a conical body and a disk body rotatably supported with their center axes crossing, the conical body and the disk body confronting each other; an enclosure wall whose inner spherical surface surrounds a space in front of a circular disk surface of the disk body, the spherical surface being concentric with the disk surface; partitioning means for dividing the space between the conical body and the disk body into a plurality of variable capacity compartments in respect of radius lines on the disk surface; and supplying/discharging through holes communicating with the variable capacity compartments;

the partitioning means comprising a partition plate movably fitted in a diameter groove of the conical body and an abutment line formed between the conical body and the disk body on their confronting surfaces; the enclosure wall is integrally connected to the disk body; and the conical body and the disk body include a synchronous mechanism that synchronizes their rotation about their center axes.

2. The swash plate type variable capacity fluid machine according to claim 1, wherein the conical body has a rear axle integrally extending along its center axis on the rear side, the rear axle having an end surface onto which an increased pressure is delivered from the variable capacity compartments via pressure channels, the end surface thus applying a counter force in the direction of the variable capacity compartments.

3. The swash plate type variable capacity fluid machine according to claim 2, wherein the rear axle has a cylindrical axle integrally constructed to support the rear axle, the cylindrical axle having a plurality of through holes made on its entire circumference at regular intervals, thereby permitting the applied fluid to pass through the through holes.

4. The swash plate type variable capacity fluid machine according to claim 1, wherein the disk body has supplying/discharging through holes communicating with the variable capacity compartments on one end and with a gate member on the other end, the gate member gating supplying/discharging channels in response to its predetermined angular positions, thereby supplying and discharging the applied fluid.

* * * * *